US007805782B2

(12) United States Patent
Hakamiun et al.

(10) Patent No.: US 7,805,782 B2
(45) Date of Patent: Oct. 5, 2010

(54) SIDERAIL FOR A HOSPITAL BED

(75) Inventors: Reza Hakamiun, Charleston, SC (US); Thomas Uzzle, Mt. Pleasant, SC (US); Mary Butler, Charleston, SC (US); Nicholas Stanfield, Toledo, OH (US); Larry A. Richer, Waseon, OH (US); Darrell Borgman, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 574 days.

(21) Appl. No.: 11/368,791

(22) Filed: Mar. 6, 2006

(65) Prior Publication Data

US 2006/0195984 A1 Sep. 7, 2006

Related U.S. Application Data

(60) Provisional application No. 60/659,221, filed on Mar. 7, 2005.

(51) Int. Cl.
*A61G 7/05* (2006.01)

(52) U.S. Cl. ..... 5/430; 5/429; 5/428

(58) Field of Classification Search ..... 5/428–430
See application file for complete search history.

(56) References Cited

U.S. PATENT DOCUMENTS 4,641,385 A * 2/1987 Peters et al. ..... 5/430
5,038,430 A * 8/1991 Bly ..... 5/425
5,083,332 A * 1/1992 Foster et al. ..... 5/185
5,083,334 A 1/1992 Huck et al.
5,129,117 A 7/1992 Celestina et al.
5,179,744 A * 1/1993 Foster et al. ..... 5/600
5,191,663 A 3/1993 Holder et al.
5,345,629 A 9/1994 Ferrand
5,394,580 A 3/1995 Foster et al.
5,732,423 A 3/1998 Weismiller et al.
5,802,636 A 9/1998 Corbin et al.
5,832,549 A 11/1998 Le Pallec et al.
5,878,452 A 3/1999 Brooke et al.
5,987,666 A * 11/1999 Zigmont ..... 5/424
6,021,533 A 2/2000 Ellis et al.
6,182,310 B1 2/2001 Weismiller et al.
6,212,714 B1 4/2001 Allen et al.
6,240,580 B1 6/2001 Hamilton et al.
6,240,583 B1 6/2001 Brooke et al.
6,295,675 B1 10/2001 Ellis et al.
6,357,065 B1 3/2002 Adams
6,363,552 B1 4/2002 Hornbach et al.
6,374,437 B1 * 4/2002 Voelker ..... 5/600
6,401,277 B1 6/2002 Savage et al.
6,427,264 B1 8/2002 Metz et al.
6,467,113 B2 10/2002 Ellis et al.
6,622,323 B2 9/2003 Zerhusen et al.
6,622,364 B2 9/2003 Hamilton et al.
6,640,360 B2 11/2003 Hornbach et al.
6,640,361 B2 11/2003 Heimbrock et al.
6,691,346 B2 2/2004 Osborne et al.

(Continued)

*Primary Examiner*—Robert G Santos
*Assistant Examiner*—Gilbert Y Lee
(74) *Attorney, Agent, or Firm*—Barnes & Thornburg LLP

(57) ABSTRACT

A hospital bed having a deck with an adjustable width. The hospital bed includes a plurality of siderails configured to extend the width of the deck. The hospital bed can support a bariatric, large or obese patient.

20 Claims, 19 Drawing Sheets

U.S. PATENT DOCUMENTS 6,704,954 B2 3/2004 Metz et al.
6,725,474 B2 4/2004 Foster et al.
6,728,985 B2 5/2004 Brooke et al.
6,751,815 B2 * 6/2004 Heimbrock et al. ..... 5/53.1
6,760,939 B2 7/2004 Ellis et al.
6,772,459 B2 * 8/2004 Nixon et al. ..... 5/429
6,779,209 B2 8/2004 Ganance
6,820,293 B2 11/2004 Alverson
6,829,793 B2 12/2004 Brooke et al.
6,862,759 B2 3/2005 Hand et al.
6,874,179 B2 4/2005 Hensley et al.
6,880,189 B2 * 4/2005 Welling et al. ..... 5/624
6,886,196 B2 * 5/2005 Nygren et al. ..... 5/430
7,024,708 B2 * 4/2006 Tomas et al. ..... 5/430
7,028,354 B2 * 4/2006 Nygren et al. ..... 5/430
7,111,348 B2 9/2006 Ellis et al.
7,260,860 B2 8/2007 Chambers et al.
7,363,663 B2 4/2008 Chambers et al.
7,406,729 B2 * 8/2008 Hornbach et al. ..... 5/613
7,461,425 B2 12/2008 Chambers et al.
7,464,425 B2 12/2008 Chambers et al.
7,565,710 B2 7/2009 Chambers et al.
7,568,247 B2 8/2009 Strobel et al.
2003/0019035 A1 * 1/2003 Heimbrock et al. ..... 5/428
2003/0177578 A1 * 9/2003 Nixon et al. ..... 5/429
2004/0123387 A1 * 7/2004 Marsden et al. ..... 5/426
2004/0128763 A1 * 7/2004 Nygren et al. ..... 5/426
2004/0211002 A1 * 10/2004 Tomas et al. ..... 5/426
2005/0229309 A1 * 10/2005 Nygren et al. ..... 5/430
2008/0127415 A1 * 6/2008 Ruschke et al. ..... 5/428
2009/0070942 A1 3/2009 Chambers et al.

* cited by examiner

SIDERAIL FOR A HOSPITAL BED

CROSS-REFERENCE TO RELATED APPLICATION

This application claims the benefit of U.S. Provisional Patent Application Ser. No. 60/659,221, filed Mar. 7, 2005, titled SIDERAIL FOR A HOSPITAL BED to Hakamiun et al., the disclosure of which is expressly incorporated by reference herein.

This application relates to U.S. Provisional Patent Application Ser. No. 60/598,817, titled Mattress Assembly, to Chambers et al., U.S. Provisional Patent Application entitled "Footboard for a Hospital Bed" (60/659368), filed concurrently herewith, and U.S. Utility Application entitled "Hospital Bed" (60/362252), and U.S. Utility Application entitled "Support Surface System" (Ser. No. 11/073795), filed concurrently herewith, the disclosures of which are expressly incorporated by reference herein.

Additionally, this application relates to U.S. patent application Ser. No. 10/890,357, filed on Jul. 13, 2004, which is a continuation application of U.S. application Ser. No. 10/254,343, filed Sep. 25, 2002, now U.S. Pat. No. 6,760,939, which is a divisional application of U.S. application Ser. No. 09/946,886, filed on Sep. 5, 2001, now U.S. Pat. No. 6,467,113, which is a continuation application of U.S. application Ser. No. 09/465,872, filed on Dec. 16, 1999, now U.S. Pat. No. 6,295,675, which is a divisional application of U.S. application Ser. No. 08/917,145 filed on Aug. 25, 1997, now U.S. Pat. No. 6,021,533, all of which are expressly incorporated by reference herein.

BACKGROUND AND SUMMARY OF THE INVENTION

The present invention relates to a hospital bed and more particularly to a hospital bed for a bariatric patient. Bariatric beds are designed for use by obese patients. Bariatric beds typically include a larger than average heavy duty frame to support the patient size and weight. The bed of the present disclosure is configured to support patients up to 1000 pounds, preferably patients between 250 pounds and 1000 pounds, although it is within the scope of the present invention to accommodate patients of 400 pounds or more including weights of greater than 1000 pounds.

According to one embodiment of the present invention, a patient support includes a frame, a deck, and a mattress supported by the deck. The mattress includes an upper surface and a lower surface. Additionally, a plurality of siderails is provided. The siderails are configured to move between a blocking position, an intermediate position, and an egress position.

According to another illustrative embodiment of the invention, a patient support includes a frame, a deck configured to move between a first width and a second width, a mattress supported by the deck, and a width adjustment assembly configured to move the deck between the first width and the second width.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The embodiments described below and shown in the figures are merely exemplary and are not intended to limit the invention to the precise forms disclosed. Instead, the embodiments were selected for description to enable one of ordinary skill in the art to practice the invention.

Figure 1:
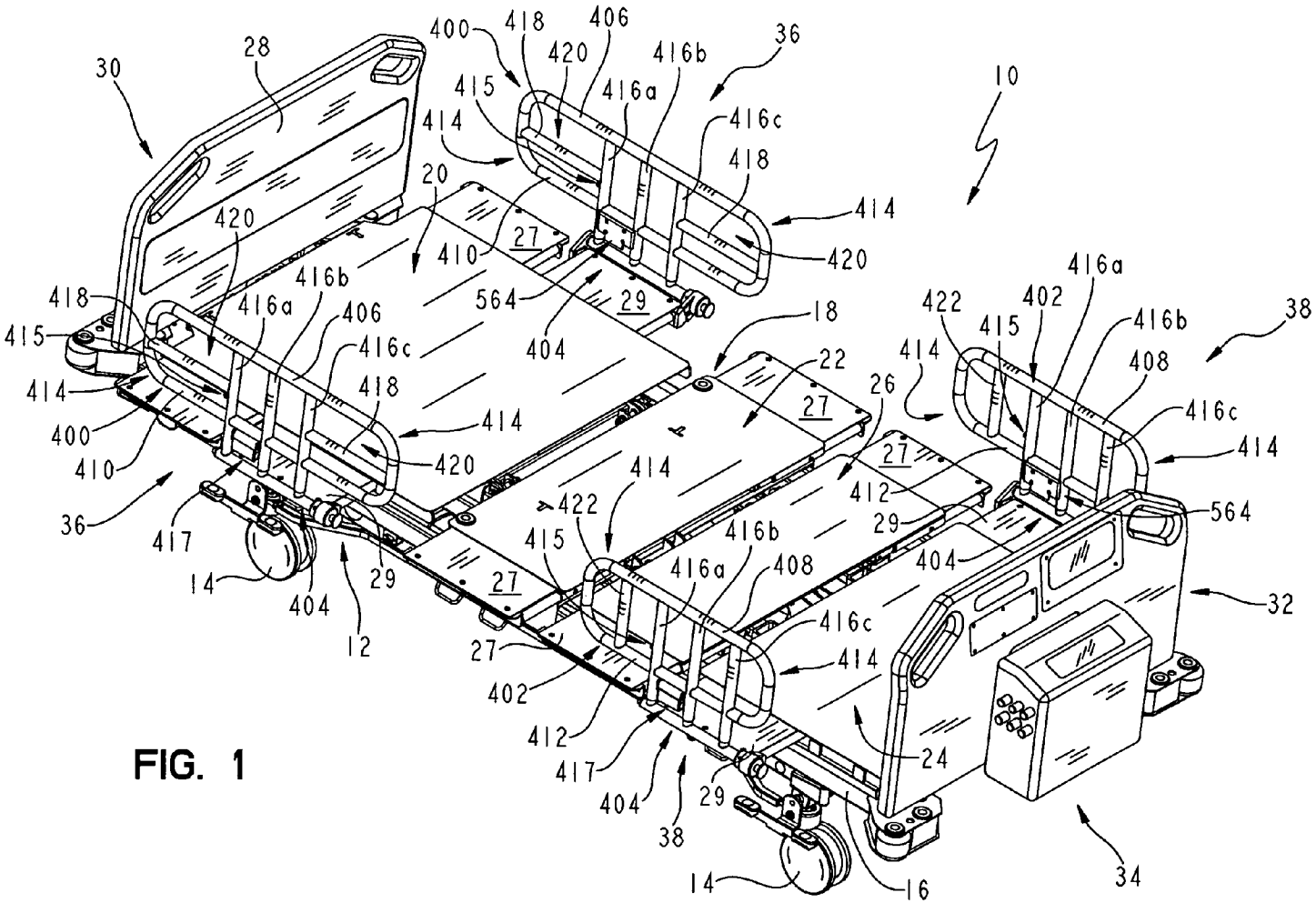
FIG. 1 is a perspective view of an illustrative embodiment patient support.

Referring initially to FIG. 1, a patient support 10 is illustrated as including a base frame 12 supported by a plurality of casters 14. An intermediate frame 16 is supported by the base frame 12 and is coupled to an articulating support deck 18. The support deck 18 is of conventional design and illustratively includes a plurality of sections configured to articulate relative to one another, including a head section 20 pivotally coupled to a seat section 22, and a foot section 24 pivotally coupled to the seat section 22. In the illustrative embodiment, a thigh section 26 is pivotally coupled intermediate the seat section 22 and the foot section 24. Further illustratively, the seat section 22 may be rigidly mounted to the intermediate frame 16 to prevent movement therebetween.

The support deck 18 includes sliding panels 27 and siderail sliding panels 29 which may be moved laterally to expand and retract the width of the deck 18. Examples of expanding support decks are provided in U.S. Patent Application entitled "BARIATRIC BED", filed Jul. 28, 2004 (60/591838) and U.S. Pat. Nos. 6,212,714 and 6,357,065, the disclosures of which are expressly incorporated by reference herein.

A headboard 28 is mounted to the intermediate frame 16 adjacent a head end 30 of patient support 10, and a footboard 32 is mounted to the intermediate frame 16 adjacent a foot end 34 of patient support 10. The patient support 10 further includes a pair of head end siderail assemblies 36 and a pair of foot end siderail assemblies 38 coupled to the support deck 18 through the associated siderail sliding panels 29 on opposite sides of the patient support 10.

Figure 2:
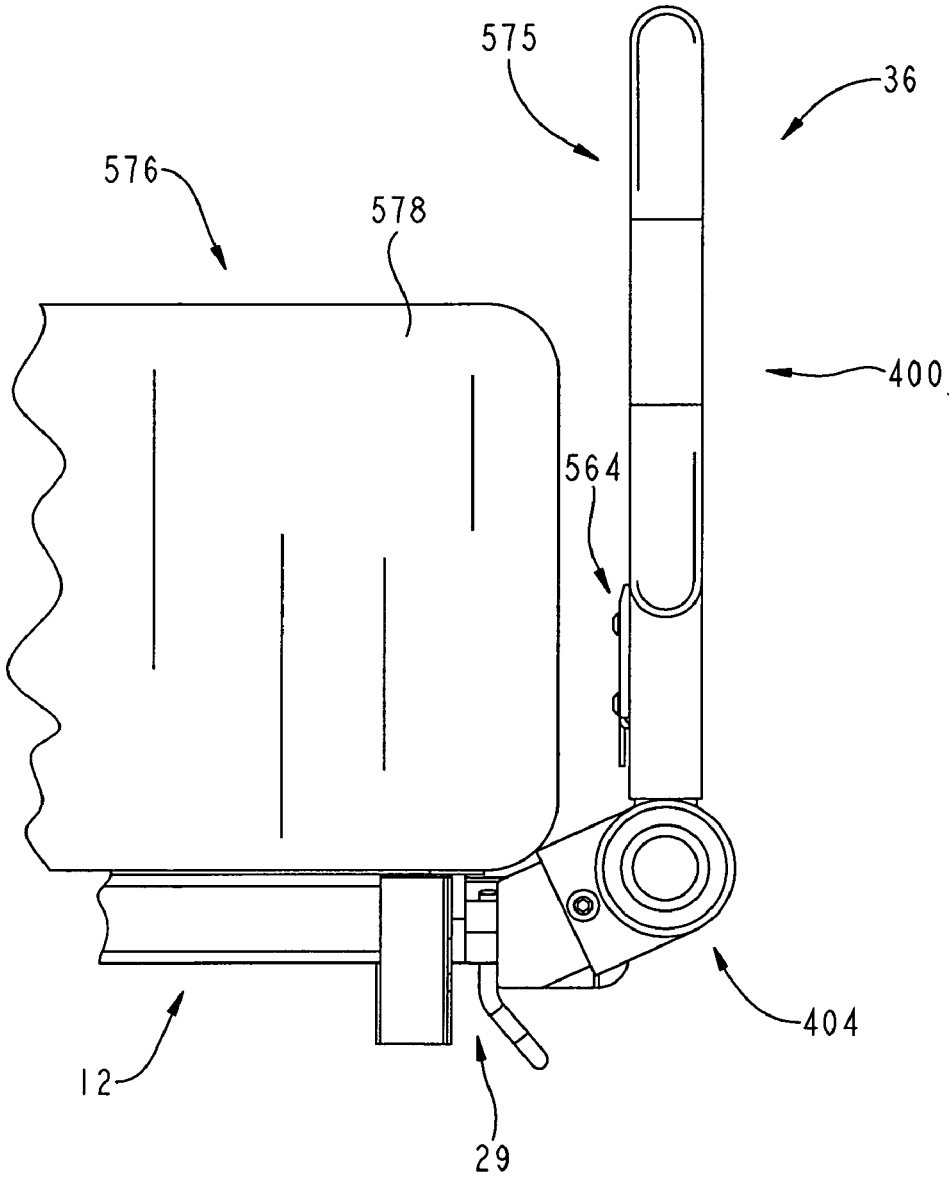
FIG. 2 is a side view of the patient support showing a mattress and an illustrative siderail assembly in an intermediate position.
Figure 4:
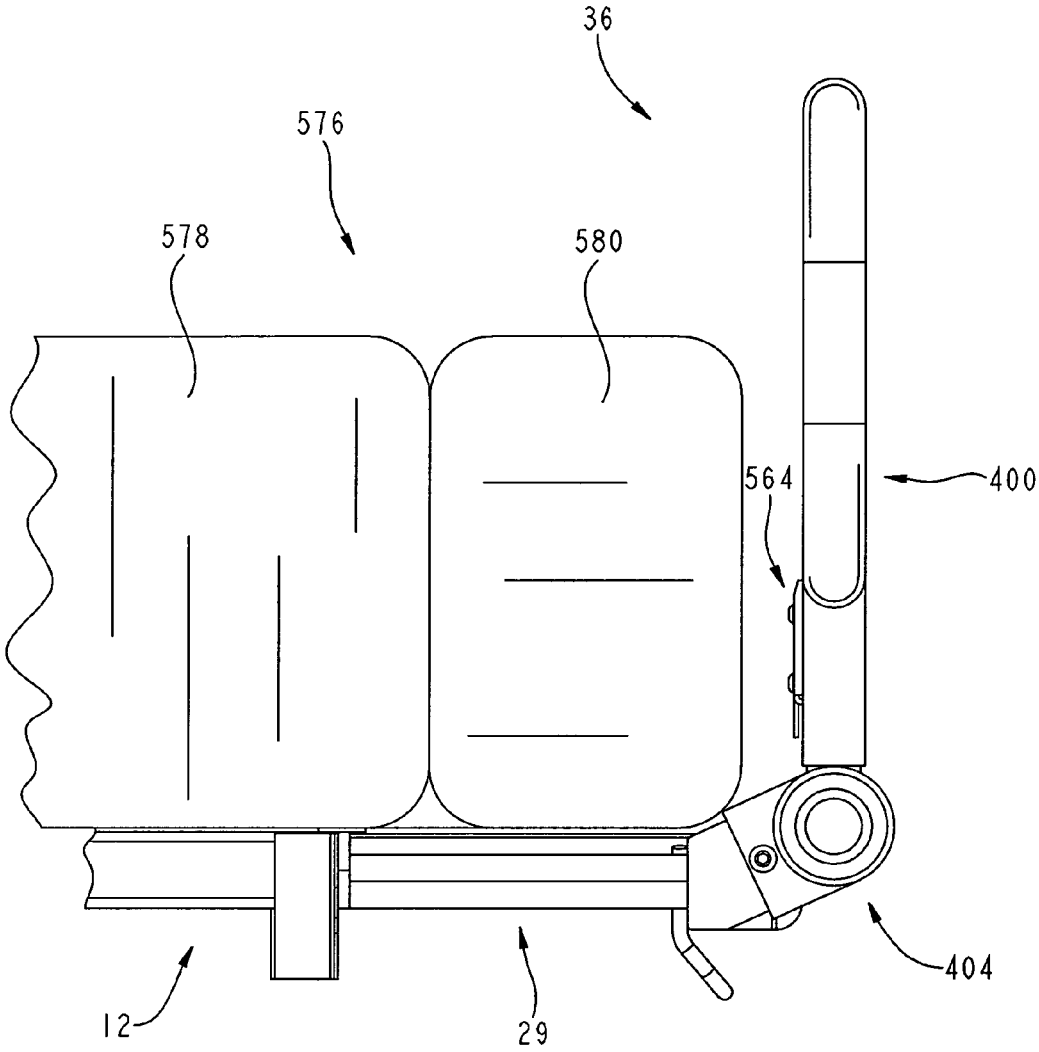
FIG. 4 is a side view of the patient support similar to FIG. 2 showing the mattress with a bolster and the siderail assembly in an extended position and the intermediate position.
Figure 5:
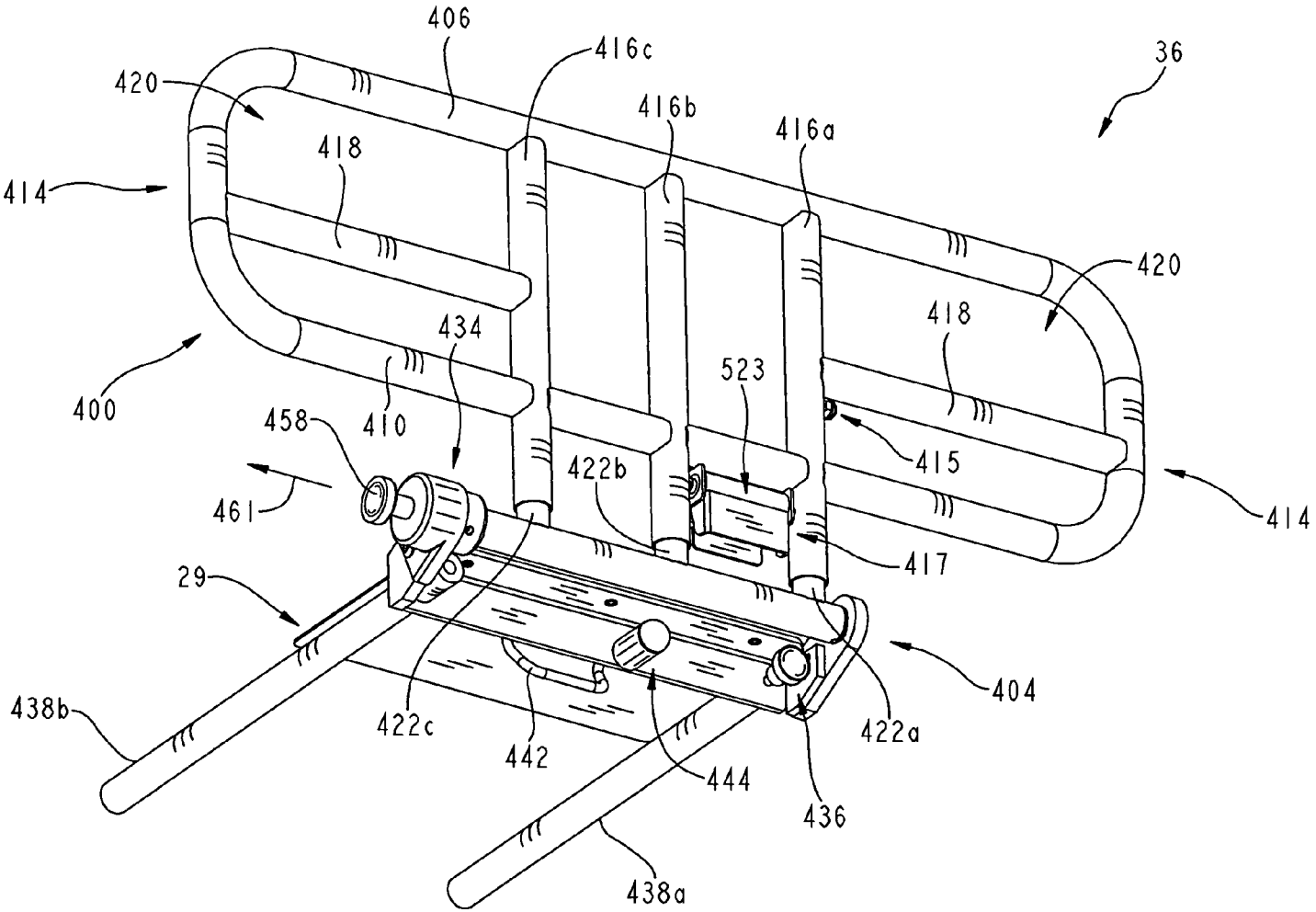
FIG. 5 is a perspective view of the siderail assembly of FIG. 2.
Figure 6:
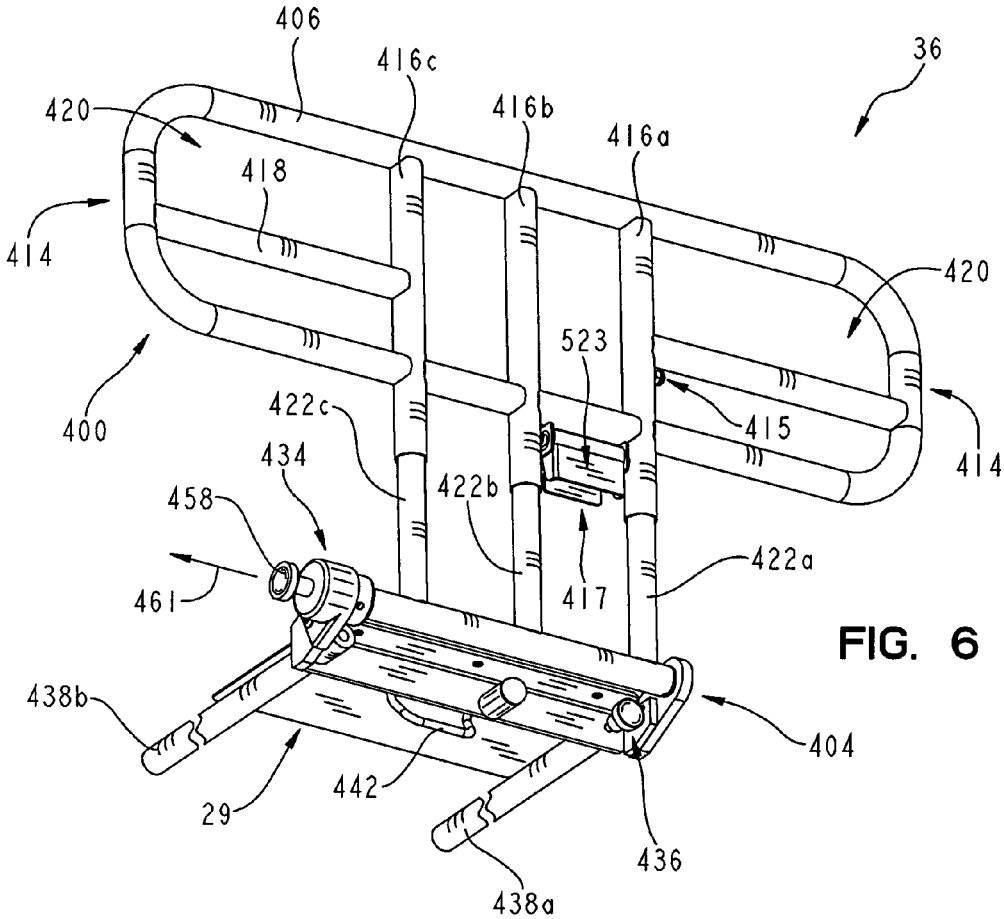
FIG. 6 is a perspective view of the siderail assembly similar to FIG. 5 showing the siderail assembly in a blocking postion.
Figure 7:
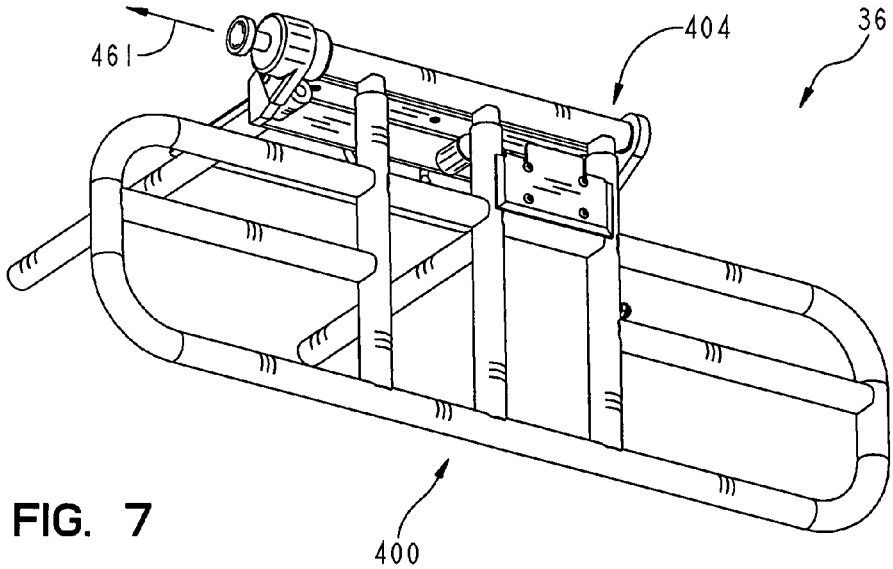
FIG. 7 is a perspective view of the siderail assembly similar to FIG. 5 showing the siderail assembly in the egress position.

Head end and foot end siderail assemblies 36, 38 are configured to move between a first deck position, as shown in FIG. 2, and a second deck position, as shown in FIG. 4 to permit the siderail assemblies 36, 38 to move with siderail sliding panels 29. Additionally, head end and foot end siderail assemblies 36, 38 are configured to move between first raised or blocking position, as shown in FIG. 6, a second raised or intermediate position, as shown in FIG. 5, and a lowered or egress positions, as shown in FIG. 7, to permit entry and egress of patients into and out of patient support 10. The siderail assemblies include structural components, described herein, selected to support the stated patient weights.

The blocking position is intended to prevent a patient (not shown) from exiting from patient support 10. The intermediate position allows a caregiver (not shown) access to the patient while still maintaining some hindrance to patient egress. The egress position allows a caregiver additional access to the patient and for movement of the patient from patient support 10. Additionally, the blocking, intermediate, and egress positions of the siderail assemblies 36, 38 allow for reducing the likelihood of patient egress and allowing a low bed exit position (not shown). Each of the blocking, intermediate, and egress positions may be secured in position with a latching mechanism to be described herein.

As shown in FIG. 1, head end siderail assembly 36 includes a head end upper siderail assembly 400 and a lower siderail assembly 404. Foot end siderail assembly 38 includes a foot end upper siderail assembly 402 and lower siderail assembly 404. Upper siderail assemblies 400, 402 cooperate with lower siderail assemblies 404 to permit upper siderail assemblies 400, 402 to move between the blocking, intermediate and egress positions.

Upper siderail assemblies 400, 402 include respective upper members 406, 408, respective lower members 410, 412, curved grip members 414, lower assembly receiving members 416*a-c*, stoppers 415, and upper release assemblies 417. Head end upper siderail assembly 400 further includes a pair of blocking members 418. Blocking members 418 cooperate with upper member 406 to define a pair of openings 420 both sized to receive a removable controller (not shown). Examples of the removable controller are provided in U.S. Pat. No. 6,691,346, the disclosure of which is expressly incorporated by reference herein. Additionally, foot end upper siderail assembly 402 includes a blocking member 422. Head end siderail assembly 36 and foot end siderail 38 are similar and description of operation and components of head end siderail assembly 36 is interchangeable with foot end siderail 38. The differences between assemblies 36, 38 are mostly cosmetic and not functional.

Figure 8A:
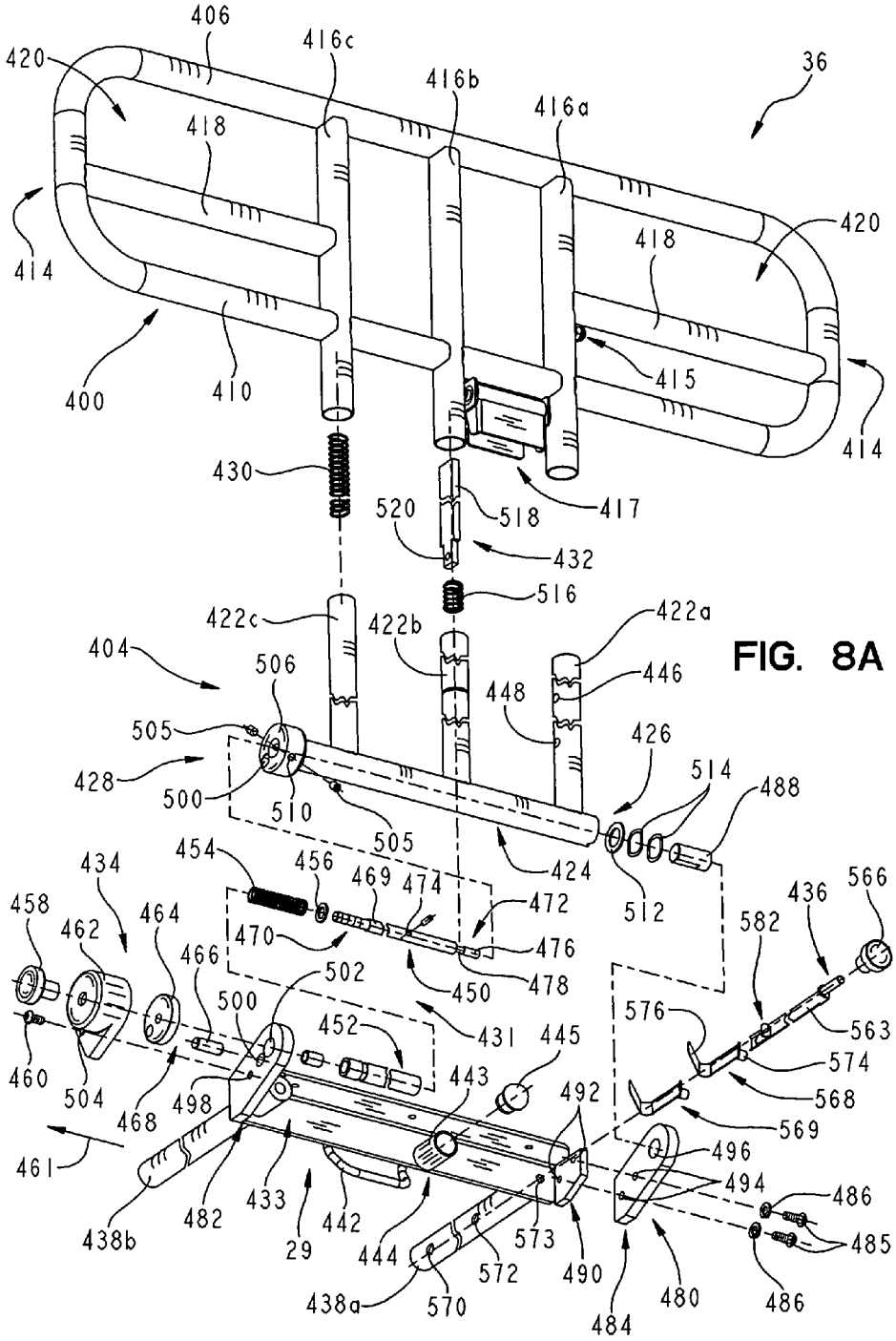
FIG. 8 is an exploded perspective view of the siderail assembly of FIG. 5.
Figure 8B:
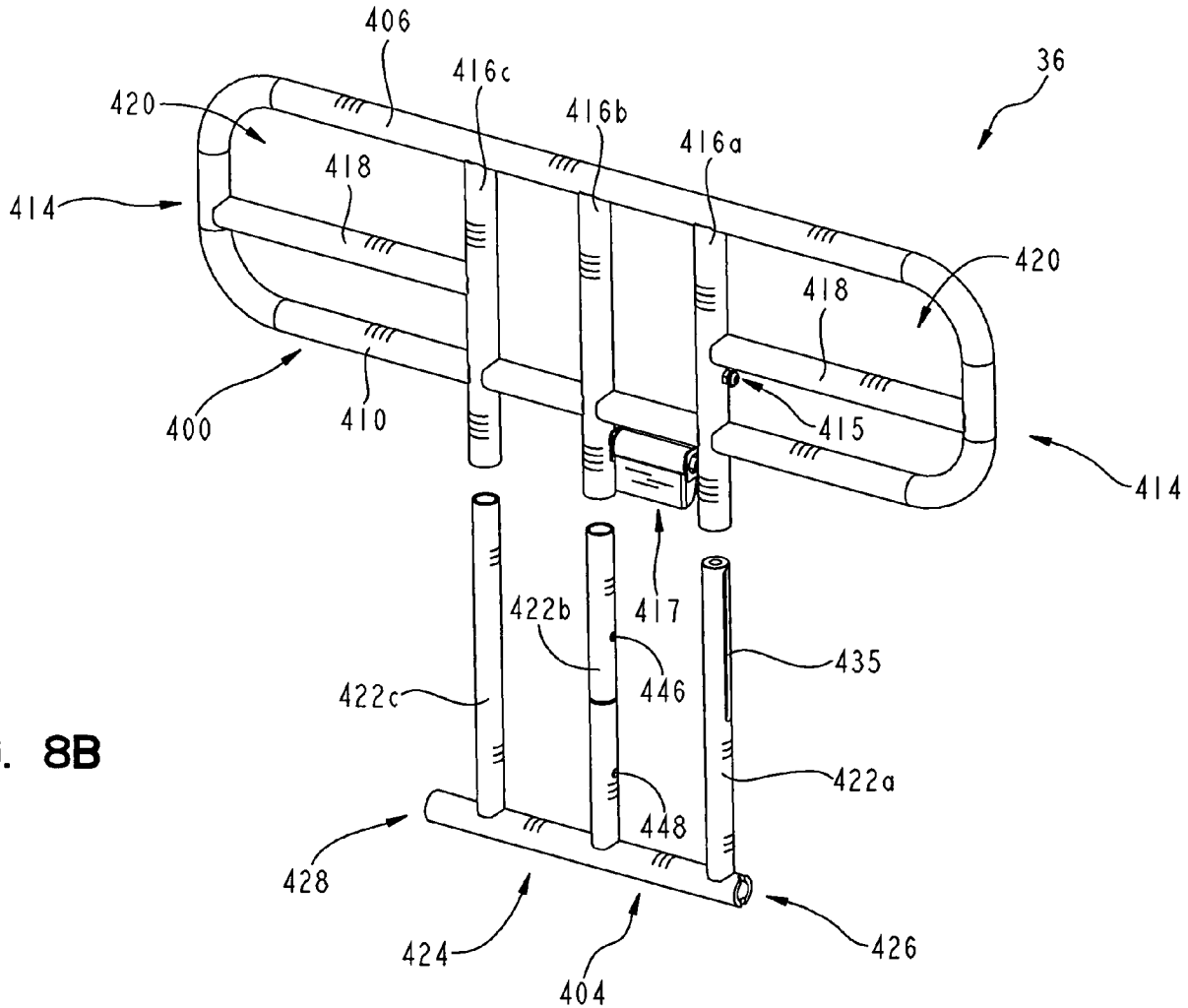

As shown in FIGS. 8A-B, lower assembly 404 includes lower assembly interactive members 422*a-c* configured to be received by respective receiving members 416*a-c*, a rotation member 424 including a first end 426 and a second end 428, a biasing spring 430 configured to bias upper siderail assemblies 400, 402 upwards, a release assembly 431, and a rotation stop 432.

As shown in FIG. 8A, siderail sliding panel 29 includes a main body 433, a rotation assembly 434 coupled to main body 433, width adjustment members 438*a-b*, a width adjustment assembly 436 configured to cooperate with adjustment member 438*a* to adjust the width of support deck 18, a restraint strap connector 442, and a siderail stop 444. Siderail stop includes a base 443 and a cap 445.

Interactive members 422*a-c* are cylindrical tubes sized to be received by respective receiving members 416*a-c*. Interactive member 422*a* includes a channel 435 configured to receive stopper 415. Preferably, stopper 415 is a screw and a washer threaded into Interactive member 422*a*. Stopper 415 prevents removal of upper siderail assemblies 400, 402 from lower siderail assemblies 404. Interactive member 422*c* supports biasing spring 430 which is received inside receiving member 416*c* to bias upper siderail assembly 400 towards the blocking position. Each interactive members 422*a-b* includes an upper latch opening 446 and a lower latch opening 448. Additionally, interactive member 422*b* receives rotation stop 432 and is received by receiving member 416*b*.

Release assembly 431 includes a release shaft 450, a release shaft tube 452, a release shaft spring 454, and a washer 456. Rotation assembly 434 includes a knob 458, a screw 460, an end cap 462, a locking hub disk 464, and a locking hub shaft 466. Locking hub disk 464 and locking hub shaft 466 cooperate to form a locking hub assembly 468. Release shaft 450 includes body 469 having a first end 470 and a second end 472, an opening 474, a stopper end 476, and a rotation stopper groove or channel 478.

Main body 433 includes a pivot end 480 and a rotation end 482. Pivot end 480 includes a pivot end plate 484, a pair of screws 485, a pair of washers 486, a pivot bar 488, and a mounting plate 490. Mounting plate 490 includes a pair of threaded holes 492. Pivot end plate 484 includes a pair of screw holes 494 and bar hole 496. Screws 485 go through holes 494 and thread into threaded holes 492. Pivot bar 488 is welded to bar hole 496. Rotation end 482 includes a threaded hole 498, a hub shaft opening 500, and a release shaft opening 502. Screw 460 fits in an opening 504 in end cap 462 and threads into threaded hole 498 holding end cap 462 in place. Hub shaft opening 500 receives and hold locking hub assembly 468.

Second end 428 includes a pair of set screws 505 and a body 506 having a pair of set screw openings 508, a shaft opening 510, and hub shaft opening 500. First end 426 includes a washer 512 and a pair of wave washers 514. Washer 512 provides a bearing surface for wave washers 514. Wave washers 514 provide resistance so upper rail assembly 400 does not abruptly swing down. Set screws 505 thread through set screw openings 508 to hold release shaft tube 452 in place.

Rotation stop 432 includes a spring 516 and a body 518 including a release shaft opening 520. Release shaft opening 520 is sized to receive stopper end 476 and positioned over rotation stopper channel 478. When siderail assemblies 400, 402 are in the blocking position, release shaft opening 520 is biased upwards into contact with rotation stopper channel 478 preventing rotation assembly 434 from allowing siderail assemblies 400, 402 to rotate. When siderail assemblies 400, 402 are in the intermediate or egress positions, release shaft opening 520 is positioned to allow stopper end 476 to move through opening 520 allowing rotation of siderail assemblies 400, 402.

Figure 9:
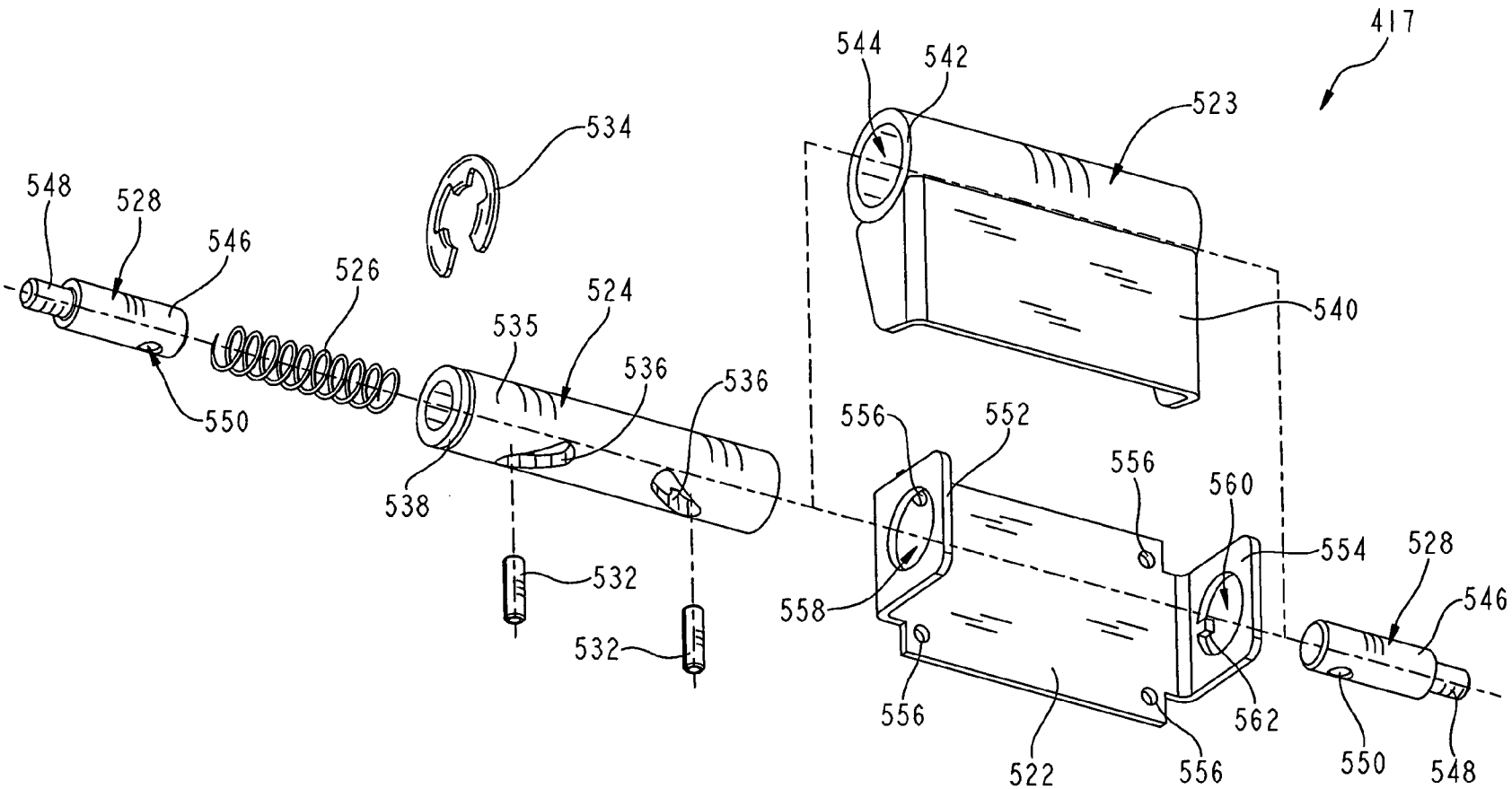
FIG. 9 is an exploded view of an illustrative embodiment latch assembly of the siderail assembly of FIG. 5.
Figure 10:
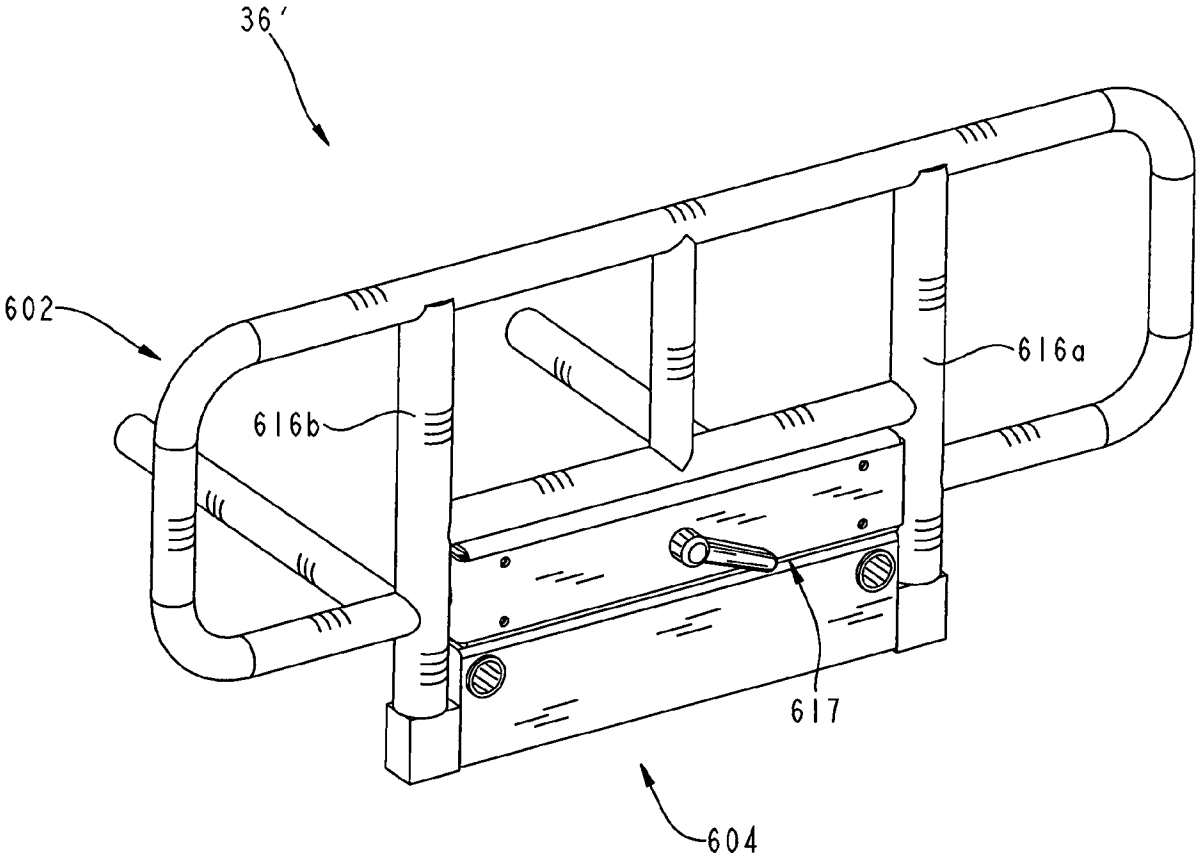
FIG. 10 is a perspective view of a further illustrative embodiment siderail assembly in a first raised position according to the present disclosure.
Figure 11:
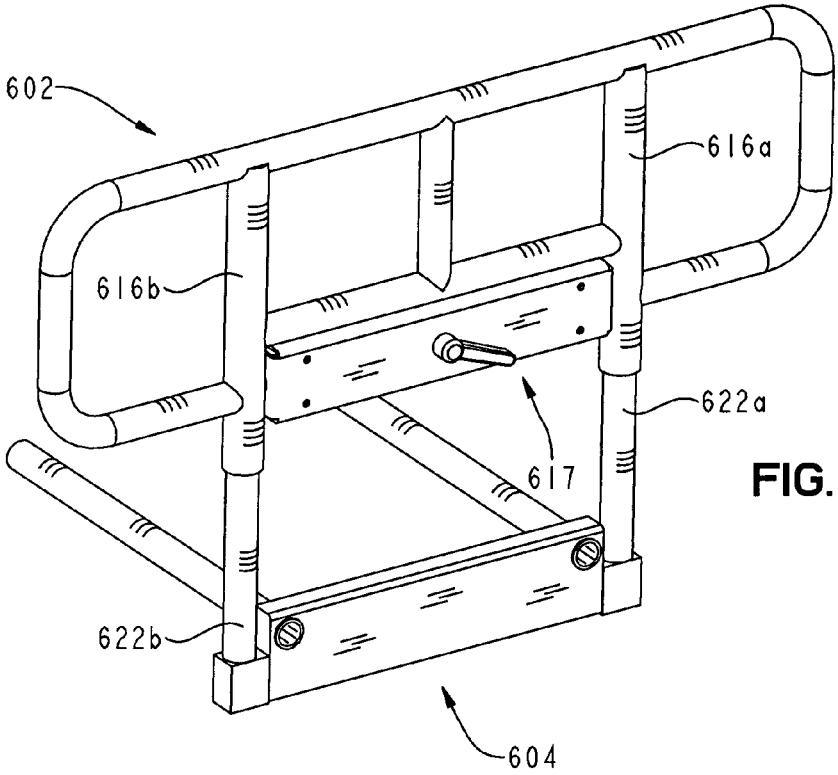
FIG. 11 is a perspective view of the siderail assembly of FIG. 10 in a second raised position.

As shown in FIG. 9, upper release assembly 417 includes a bracket 522, a handle 523, a shaft 524, a spring 526, a pair of release members 528, a pair of holding members 532, and a snap ring 534. Shaft 524 includes a body 535, a pair of holding member apertures or channels 536, and a snap ring channel 538. Handle 523 includes a lift portion 540 and a rotation portion 542 including an opening 544 sized to receive shaft 524. Each release member 528 includes a body 546, a locking portion 548, and a holding member opening 550. Bracket 522 includes a first wing 552, a second wing 554, and bolt openings 556. First wing 552 includes a first wing opening 558 sized to receive shaft 524. Second wing 554 includes a second wing opening 560 including a stopper tab 562.

In assembly, bracket 522 bolts to a mounting plate 564 (shown in FIG. 1). Handle 523 is placed between first wing 552 and second wing 554, spring 526 is placed between release members 528. Holding members 532 are placed through holding member channels 536 into holding member openings 550 and into a pair of channels (not shown) in handle 523. Finally, snap ring 534 is place in snap ring channel 538 outside first wing 552 holding the entire assembly in place.

As shown in FIG. 8A, width adjustment assembly 436 is configured to cooperate with adjustment member 438*a* to adjust the width of support deck 18. Width adjustment assembly 436 includes an extension bar 563, a knob 566, a first spring clip 568, and a second spring clip 569. Adjustment member 438*a* includes a standard deck width hole 570, a extended deck width hole 572, and an assembly receiving opening 573. Spring clips 568, 569 each include a locking portion 574 and a biasing portion 576.

Adjustment assembly 436 is configured to slide into receiving opening 573. Spring clip 569 prevents removal of adjustment assembly 436 from adjustment member 438*a* during operation. While in the first deck position, shown in FIG. 2, locking portion 574 of button 568 is biased into standard width hole 570. While in the second deck position, shown in FIG. 4, locking portion 574 of button 569 is biased into extended deck width hole 572.

Figure 3:
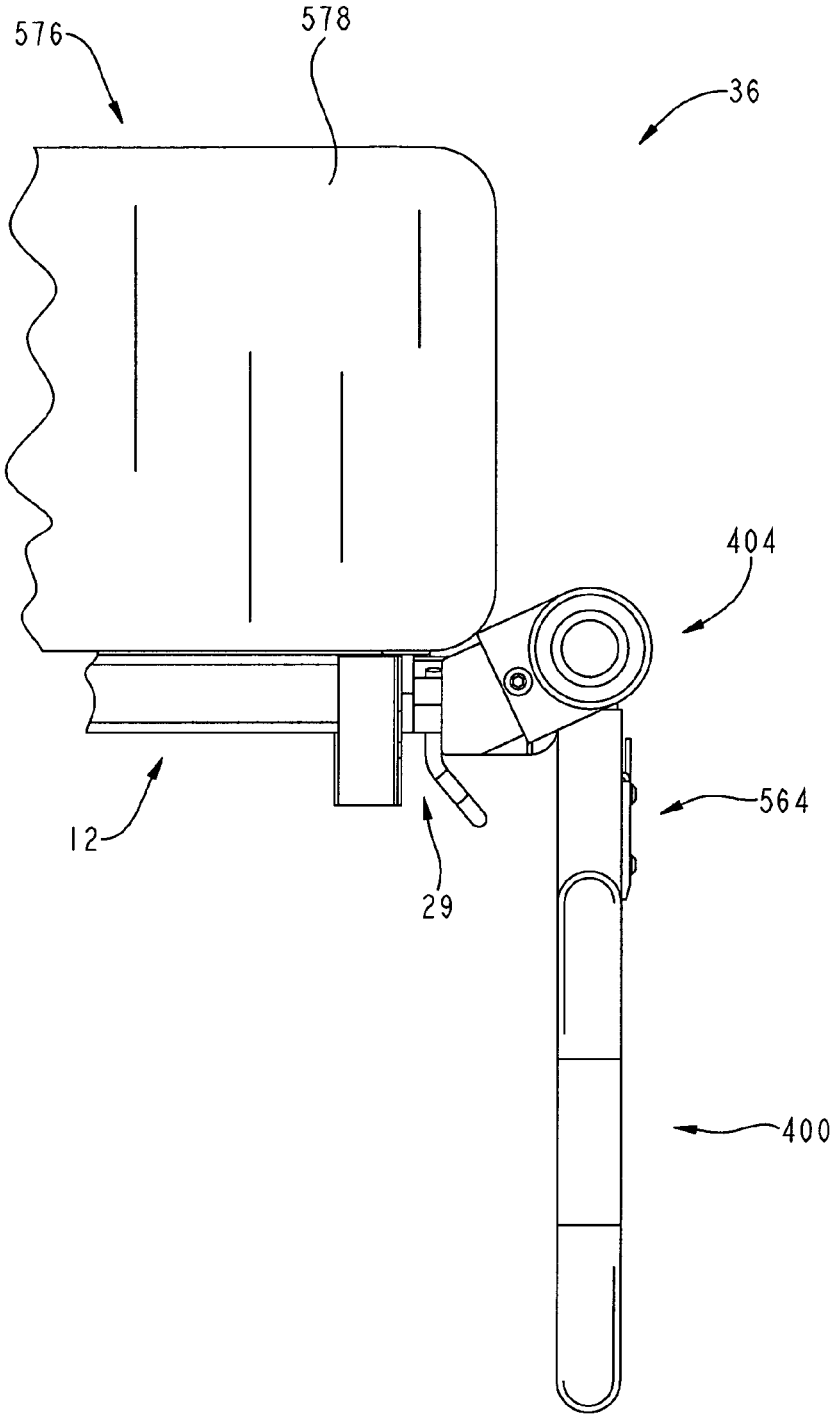
FIG. 3 is a side view of the patient support similar to FIG. 2 showing the siderail assembly in an egress position.

As shown in FIGS. 2-4, siderail assembly 36 moves between the intermediate position (FIG. 2) with a portion 575 of upper siderail assembly 400 above the upper surface of a mattress 576 and the egress position (FIG. 3) with the upper siderail assembly 400 below the surface of the mattress 576. As shown in FIG. 4, Mattress 576 includes a main body 578 and an extension body or bolster 586. Siderail assembly 36 is in the second deck position to accommodate the addition of extension body 586. Additional disclosure of the mattress structures may be found in U.S. Utility Application entitled "Hospital Bed" (60/659368) which is expressly incorporated by reference herein. In alternative embodiments, each of siderail assemblies 36, 38 will be positioned below or substantially below at least one of base frame 12, intermediate frame 16, and/or deck 18 when in the egress position.

In operation of width adjustment of deck 18, siderail sliding panels 29 must be extended. The caregiver pushes knob 566 inwards towards frame 12. Knob 566 is coupled to extension bar 563. Extension bar 563 includes a spring clip receiver 582. Spring clip receiver 582 is configured to push spring clip 568. As knob 566 moves, extension bar 563 moves away from the caregiver and out of adjustment member 438*a*. Spring clip receiver 582 depresses locking portion 574 of first spring clip 568 and allows slide assembly 29 to be pulled until locking portion 574 of second snap button 569 engages the end of the socket (not shown). Locking portion 574 of spring button 568 is then locked in the socket hole and second snap button 569 is locked at the end of the socket preventing movement of slide assembly 29 from moving in either direction. Spring clip receiver 582 is a channel of sufficient length to allow locking portion 574 to remain in extended deck width hole 572 and allow knob 566 to return to its initial position. In alternative embodiments, there could be multiple width positions requiring additional deck width holes.

In operation to move between the intermediate position (FIG. 5) and the blocking position (FIG. 6), the caregiver uses upper release assembly 417. The caregiver lifts handle 523. Holding members 532 move along holding member channels 536 and the pair of holding channels in handle 523 causing movement of release members 528 inwards. This movement moves release members 528 out of contact with lower latch openings 448. The caregiver begins lifting upper siderail assembly 400 and releases handle 523. This allows the caregiver to raise the upper siderail assembly 400 until release members 528 snap into upper latch opening 446 locking upper siderail assembly 400 into blocking position. Stopper 415 is positioned in channel 433. This prevents a caregiver from accidentally removing the upper siderail assembly 400 from lower siderail assembly 404 without removing stopper 415.

Additionally, when siderail assemblies 400, 402 are in the blocking position, release shaft opening 520 is biased upwards into contact with rotation stopper channel 478 preventing rotation assembly 434 from allowing siderail assemblies 400, 402 to rotate. When siderail assemblies 400, 402 are in the intermediate or egress positions, release shaft opening 520 is positioned to allow stopper end 476 to move through opening 520 allowing rotation of siderail assemblies 400, 402. This allows rotation of siderail assemblies 400, 402 only when the siderail is in the intermediate position. In alternative embodiments, rotation stop 423 could be removed allowing rotation in all positions.

In operation to move between the intermediate position (FIG. 5) and the egress position (FIG. 7), the caregiver uses rotation assembly 434. The caregiver pulls knob 458 in a direction 461 away from lower assembly 404. Pulling knob 458 in direction 461 moves locking hub disk 464 in the same direction as knob 458. This pulls locking hub shaft 466 from hub shaft opening 500 allowing rotation of siderail assembly 36. After rotation begins, the caregiver releases knob 458 and spring 454 biases knob 458 to its original position. Siderail assembly 36 is not locked in the egress position and movement of siderail assembly 36 is enabled without additional movement of knob 458. As siderail assembly 36 is returned to the intermediate position, shaft 466 slides into hub shaft opening 500. In alternative embodiments, an addition hub shaft opening 500 is positioned opposition hub shaft opening to lock siderail assembly 36 in the egress position.

Figure 12:
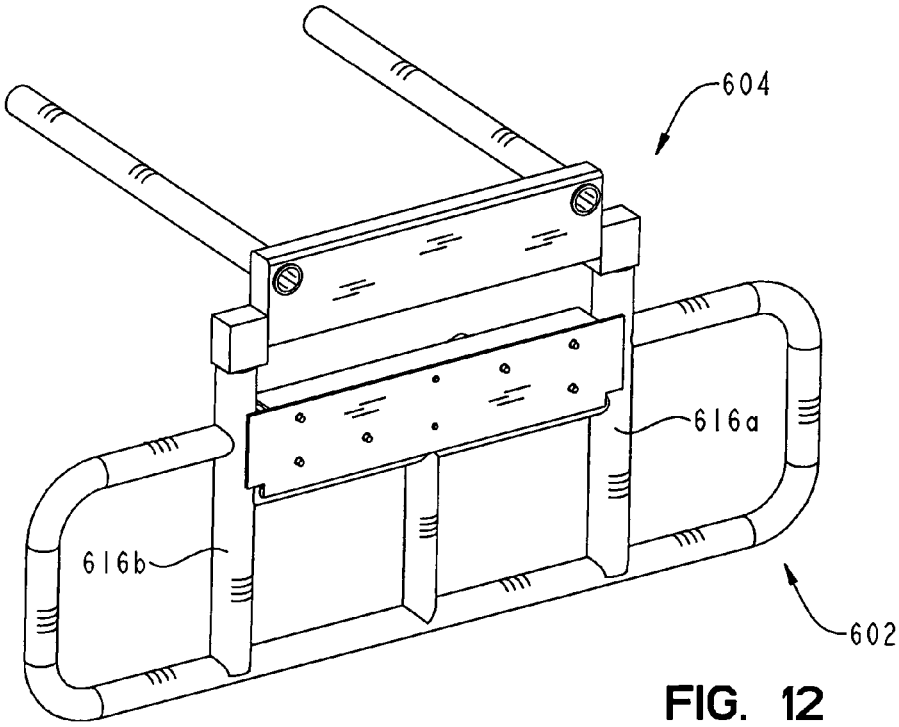
FIG. 12 is a perspective view of the siderail assembly of FIG. 10 in a lowered position.

Another illustrative embodiment siderail assembly 36' is shown in FIGS. 10-13. Siderail assembly 36' includes an upper siderail assembly 602 and lower siderail assembly 604. Upper siderail assembly 602 cooperates with lower siderail assembly 604 to permit upper siderail assembly 602 to move between the blocking position (FIG. 11), the intermediate position (FIG. 10), and the egress position (FIG. 12).

Upper siderail assembly 602 includes, lower assembly receiving members 616*a*, 616*b* and an upper release assembly 617. Lower assembly 604 includes lower assembly interactive members 622*a*, 622*b* configured to be received by respective receiving members 616*a*, 616*b*.

Figure 13:
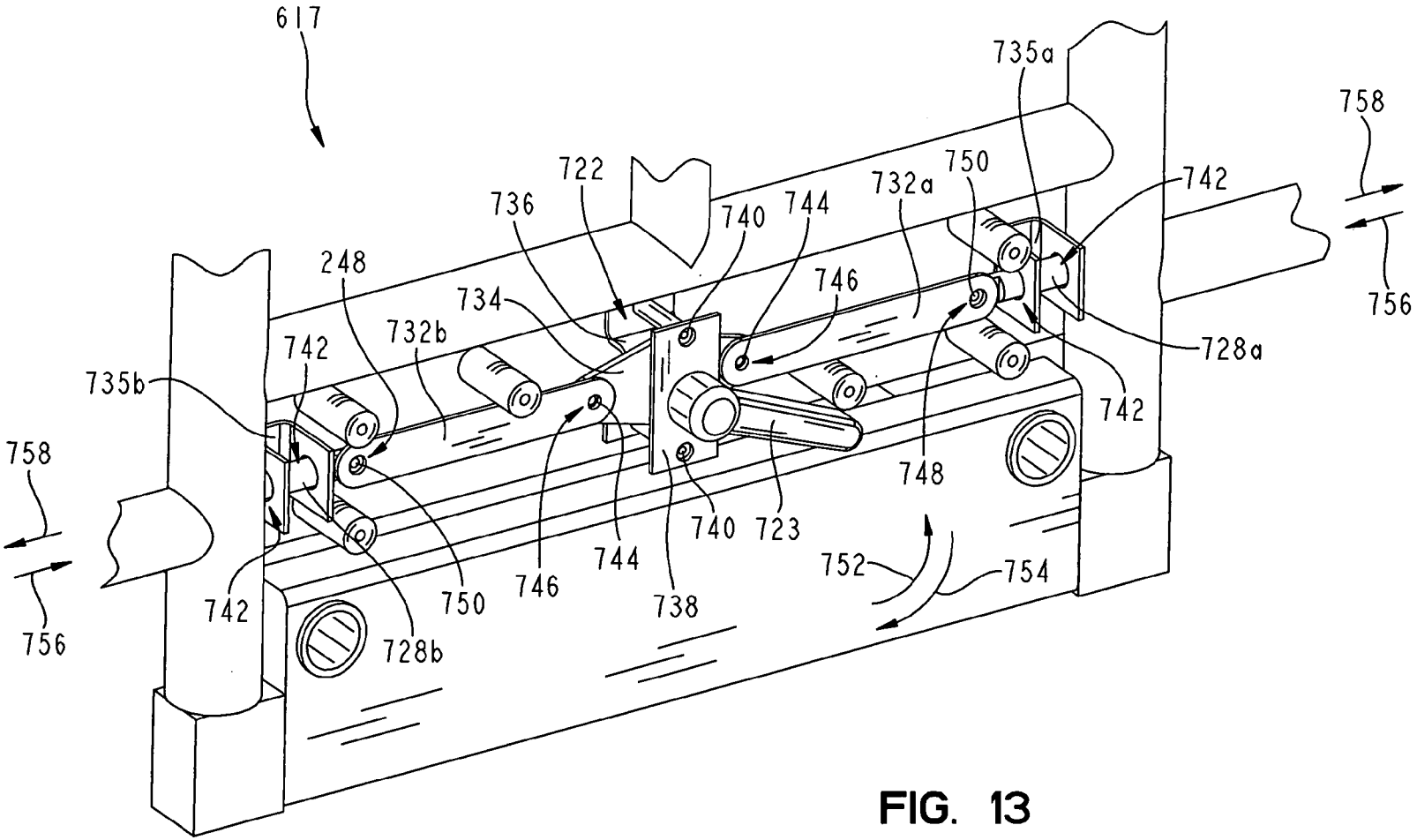
FIG. 13 is a perspective view, with a partial cut-away, of the siderail assembly of FIG. 10.
Figure 14:
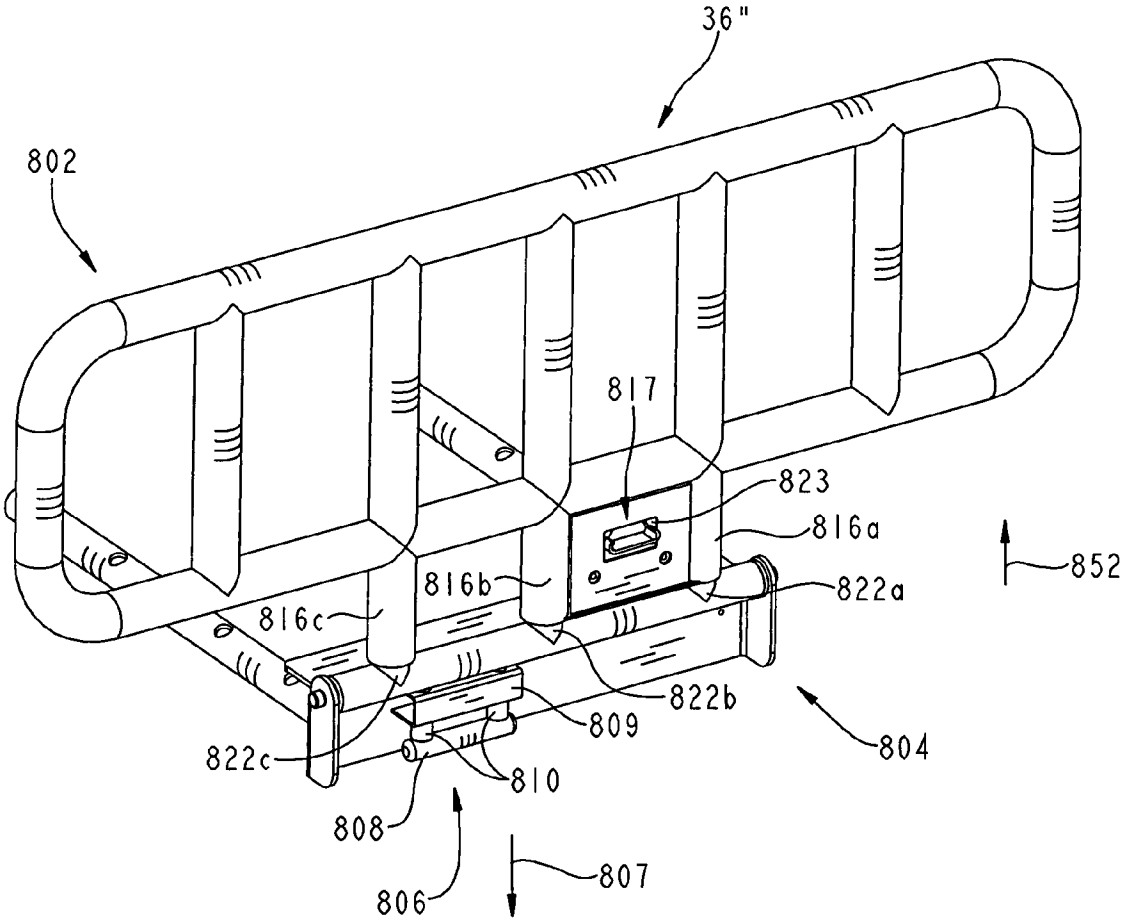
FIG. 14 is a perspective view of a further illustrative embodiment siderail assembly in a first raised position according to the present disclosure.
Figure 15:
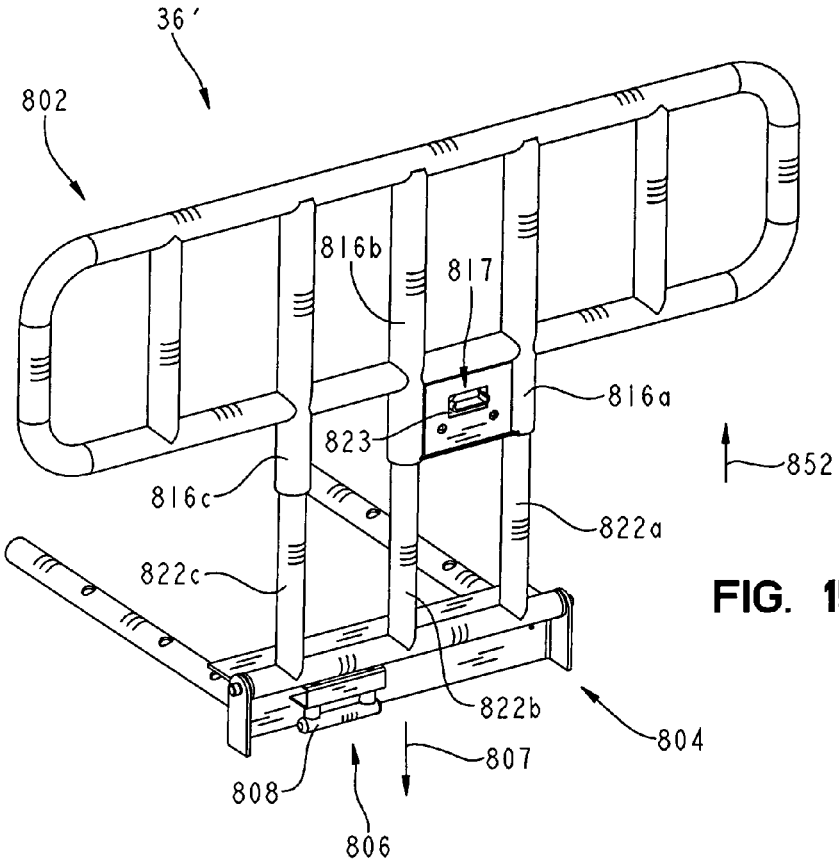
FIG. 15 is a perspective view of the siderail assembly of FIG. 14 in a second raised position.

As shown in FIG. 13, upper release assembly 617 includes a bracket 722, a handle 723, a shaft (not shown), a pair of release members 728*a*, 728*b*, a pair of first links 732*a*, 732*b*, a main link 734, and a pair of outer brackets 735*a*, 735*b*. Bracket 722 includes a back member 736, a front member 738, and retaining members 740. Handle 723 couples to the shaft (not shown). The shaft (not shown) is positioned through front member 738 and is welded to main link 734. In alternative embodiments the shaft maybe press fit in an opening (not shown) in main link 734. Outer brackets 735*a, b* contain openings 742 configured to receive respective release members 728*a*, 728*b*. Main link 734 includes a pair of coupling members 744. Release members 728*a, b* include first link coupling members 750. First links 732*a*, each include a main bracket receiver 746 and a release member receiver 748. Main bracket receivers 746 receive coupling members 744 and release member receivers 748 receive first link coupling members 750.

Release members 728*a, b* are configured to move between a locked position interacting with an intermediate position opening (not shown) and a locked position interacting with a blocking position opening (not shown). Both intermediate position opening (not shown) and blocking position opening (not shown) located through a first wall (not shown) in both lower assembly interactive members 622*a*, 622*b* and receiving members 616*a*, 616*b*.

In operation to move between the intermediate position (FIG. 10) and the blocking position (FIG. 11), the caregiver rotates handle 723 in either a first direction 752 or second direction 754. Rotation of handle 723 in either first or second directions 752, 754 moves release members 728*a*, 728*b* in an inward direction 756 out of contact with both lower assembly interactive members 622*a*, 622*b* and receiving members 616*a*, 616*b*. Handle 723 is biased to the starting position. When the caregiver releases handle 723 release members 728*a*, 728*b* move in the outward position 758 into contact with both lower assembly interactive members 622*a*, 622*b* and receiving members 616*a*, 616*b*. While in contact with both lower assembly interactive members 622*a*, 622*b* and receiving members 616*a*, 616*b* upper siderail assembly 602 is locked in either the intermediate position or the blocking position.

Figure 16:
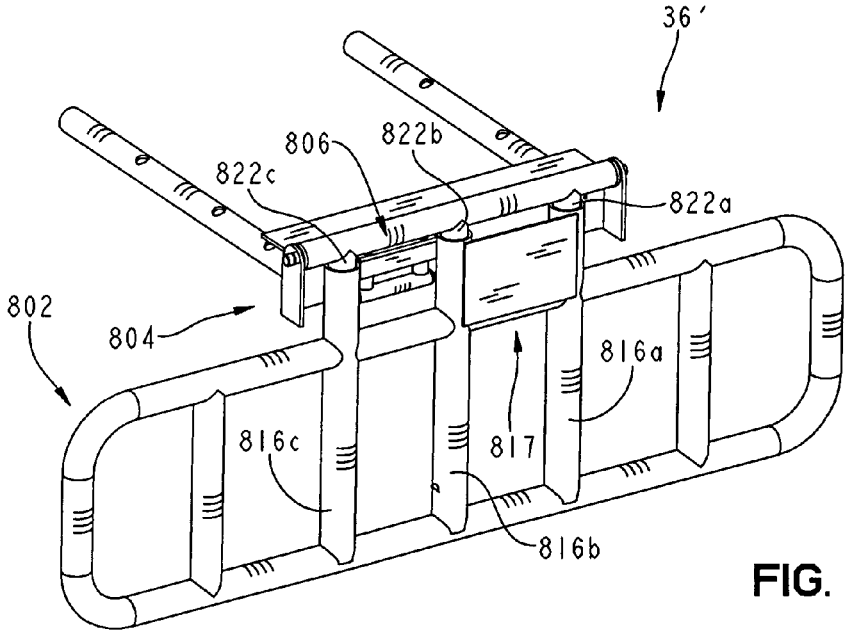
FIG. 16 is a perspective view of the siderail assembly of FIG. 14 in a lowered position.

Another illustrative embodiment siderail assembly 36" is shown in FIGS. 14-17. Siderail assembly 36" includes an upper siderail assembly 802 and lower siderail assembly 804. Upper siderail assembly 802 cooperates with lower siderail assembly 804 to permit upper siderail assembly 802 to move between the blocking position (FIG. 15), the intermediate position (FIG. 14), and the egress position (FIG. 16). Upper siderail assembly 802 includes, lower assembly receiving members 816*a-c* and an upper release assembly 817. Lower assembly 804 includes a rotation assembly 806 and lower assembly interactive members 822*a-c* configured to be received by respective receiving members 816*a-c*.

Rotation assembly 806 includes a handle 808, bracket 809, a pair of springs (not shown), and a pair of release members 810 configured to cooperate with a pair of openings (not shown) in lower siderail assembly 804. Release members 810 are biased into the pair of openings by the pair of springs (not shown). In alternative embodiments an additional pair of openings is provided to interact with release members 810 to lock siderail assembly 36" in the egress position.

Figure 17:
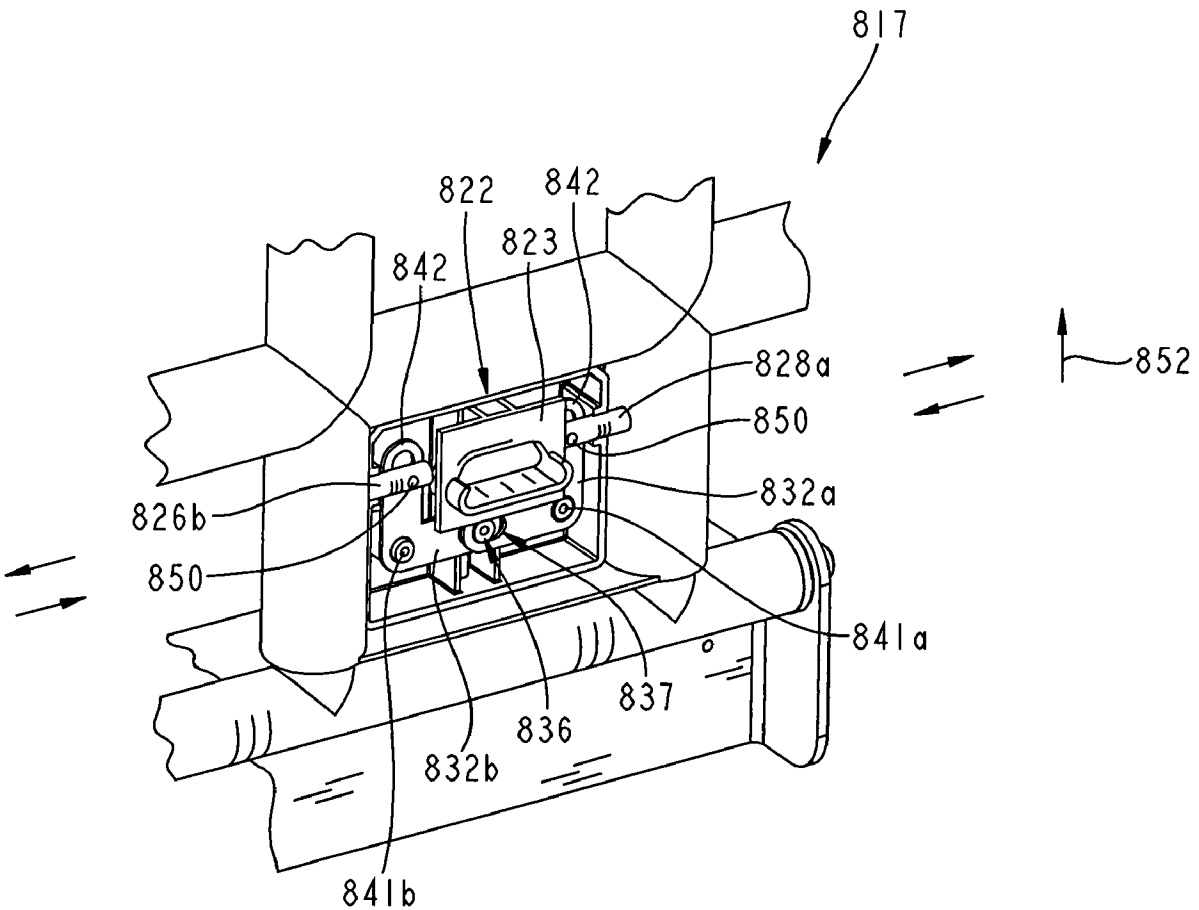
FIG. 17 is a perspective view, with a partial cut-away, of the siderail assembly of FIG. 14.

As shown in FIG. 17, upper release assembly 817 includes a bracket 822, a handle 823, a shaft (not shown), a pair of release members 828*a*, 828*b*, a pair of first links 832*a*, 832*b*, and a main link (not shown). Handle 823 couples to a shaft 836 through the main link (not shown). Shaft 836 is positioned through first openings 837. First links 832*a*, 832*b* contain openings 842 configured to receive respective release members 828*a*, 828*b*. Additionally, first links 832*a*, 832*b* are configured to pivot around respective pivot shafts 841*a*, 841*b*. Release members 828*a*, 828*b* include first link coupling members 850.

Release members 828*a*, 828*b* are configured to move between a locked position interacting with an intermediate position opening (not shown) and a locked position interacting with a blocking position opening (not shown). Both intermediate position opening and blocking position opening located through a first wall (not shown) of both lower assembly interactive members 822*a*, 822*b* and receiving members 816*a*, 816*b*.

In operation to move between the intermediate position (FIG. 14) and the blocking position (FIG. 15), the caregiver lifts handle 823 in an upward direction 852. Lifting handle 823 in upward direction 852 moves release members 828*a*, 828*b* in an inward direction 856 out of contact with both interactive members 822*a*, 822*b* and receiving members 816*a*, 816*b*. Handle 823 is biased to the starting position. The caregiver starts lifting upper assembly 802. After the caregiver begins lifting upper assembly 802, the caregiver releases handle 823 release members 828*a*, 828*b* move in the outward position 858 into contact with both lower assembly interactive members 822*a*, 822*b* and receiving members 816*a*, 816*b*. While in contact with both lower assembly interactive members 822*a*, 822*b* and receiving members 816*a*, 816*b* upper siderail assembly 802 is locked in either the intermediate position or the blocking position.

In operation to move between the intermediate position (FIG. 14) and the egress position (FIG. 16), the caregiver uses rotation assembly 806. The caregiver pulls handle 808 downwards in a direction 807. Pulling handle 808 moves release members 810 out of contact the pair of openings in lower siderail assembly 804 allowing rotation of siderail assembly 36". After rotation begins, the caregiver releases handle 808 and the pair of springs bias handle 808 towards its original position. Siderail assembly 36" is not locked in the egress position and rotation upwards of siderail assembly 36" is enabled without additional movement of handle 808. As it returns to the intermediate position, release members 810 slide into the pair of openings in lower siderail assembly 804.

Figure 18:
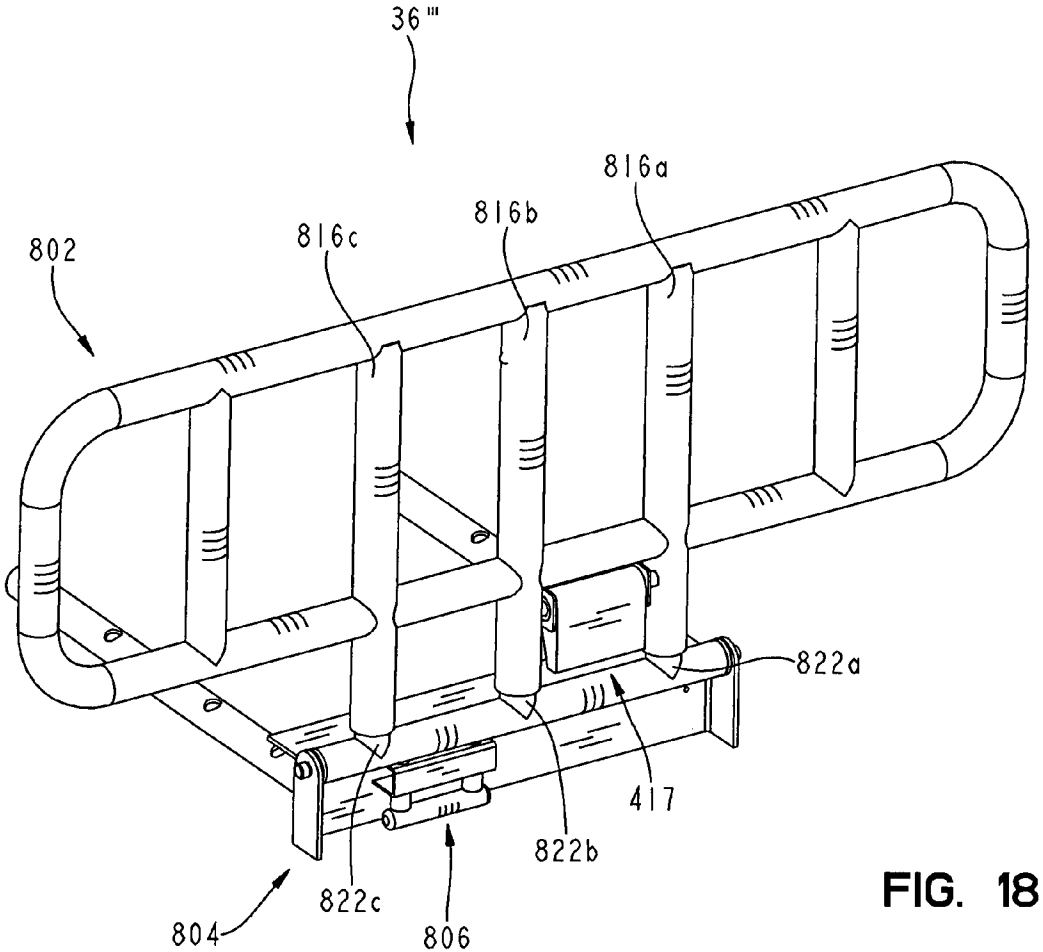
FIG. 18 is a perspective view of a further illustrative embodiment siderail assembly in a first raised position.

Another illustrative embodiment siderail assembly 36'" is shown in FIG. 18. Siderail assembly 36'" uses all the same components as siderail assembly 36" except it uses upper release assembly 417 from siderail assembly 36. Upper release assembly 417 of siderail assembly 36'" includes all components and operates as does upper release assembly 417 of siderail assembly 36.

Figure 19:
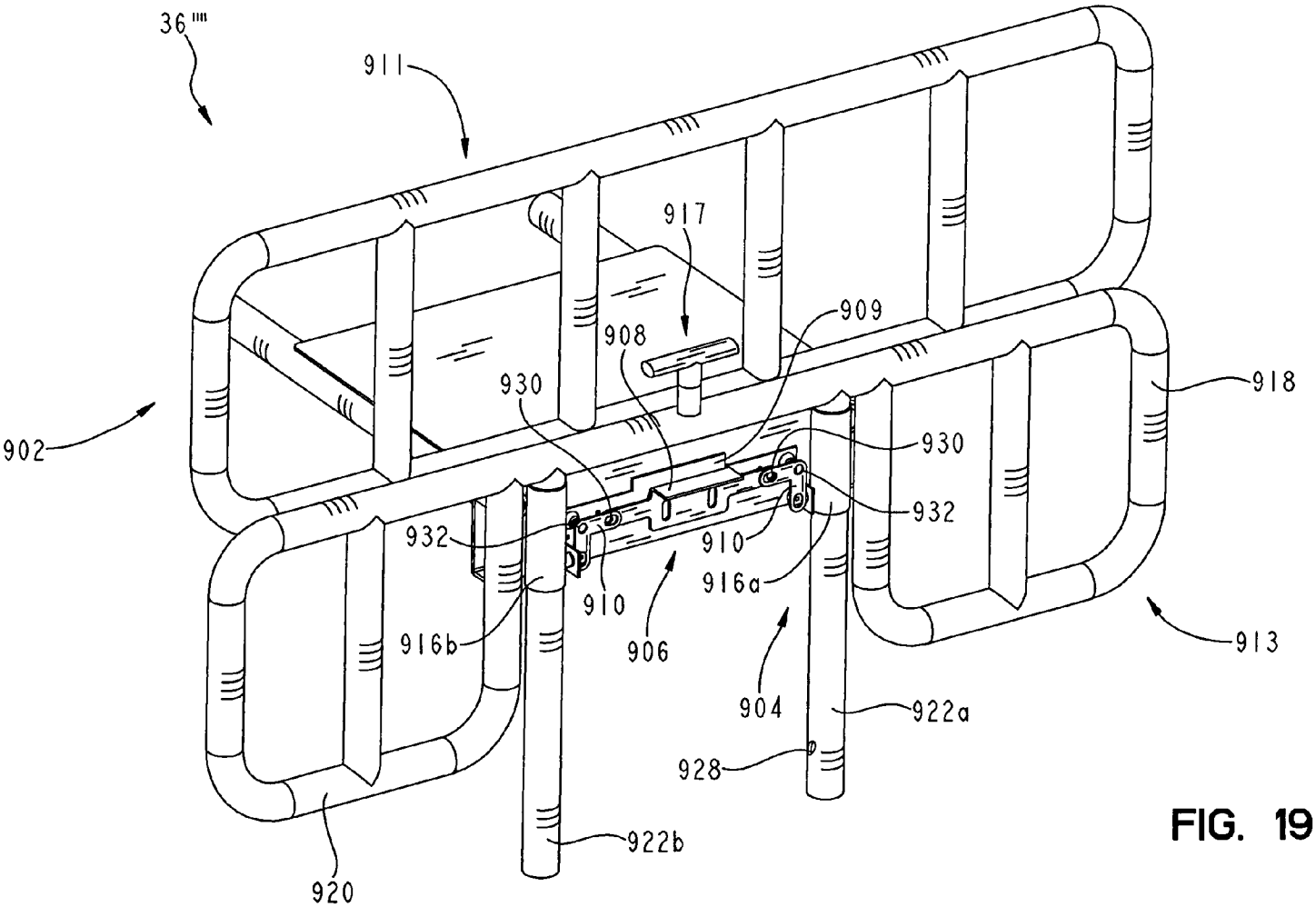
FIG. 19 is a perspective view of a further illustrative embodiment siderail assembly in a first raised position.
Figure 20:
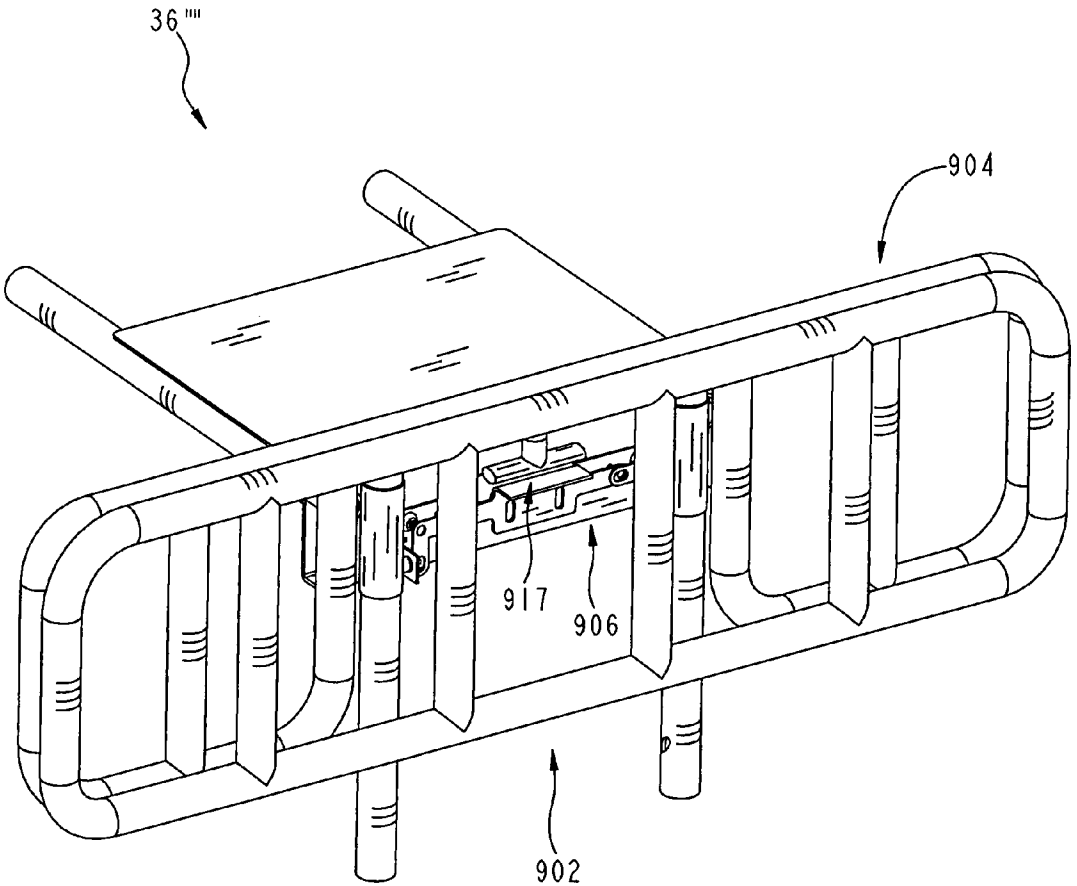
FIG. 20 is a perspective view of the siderail assembly of FIG. 19 in a second raised position.
Figure 21:
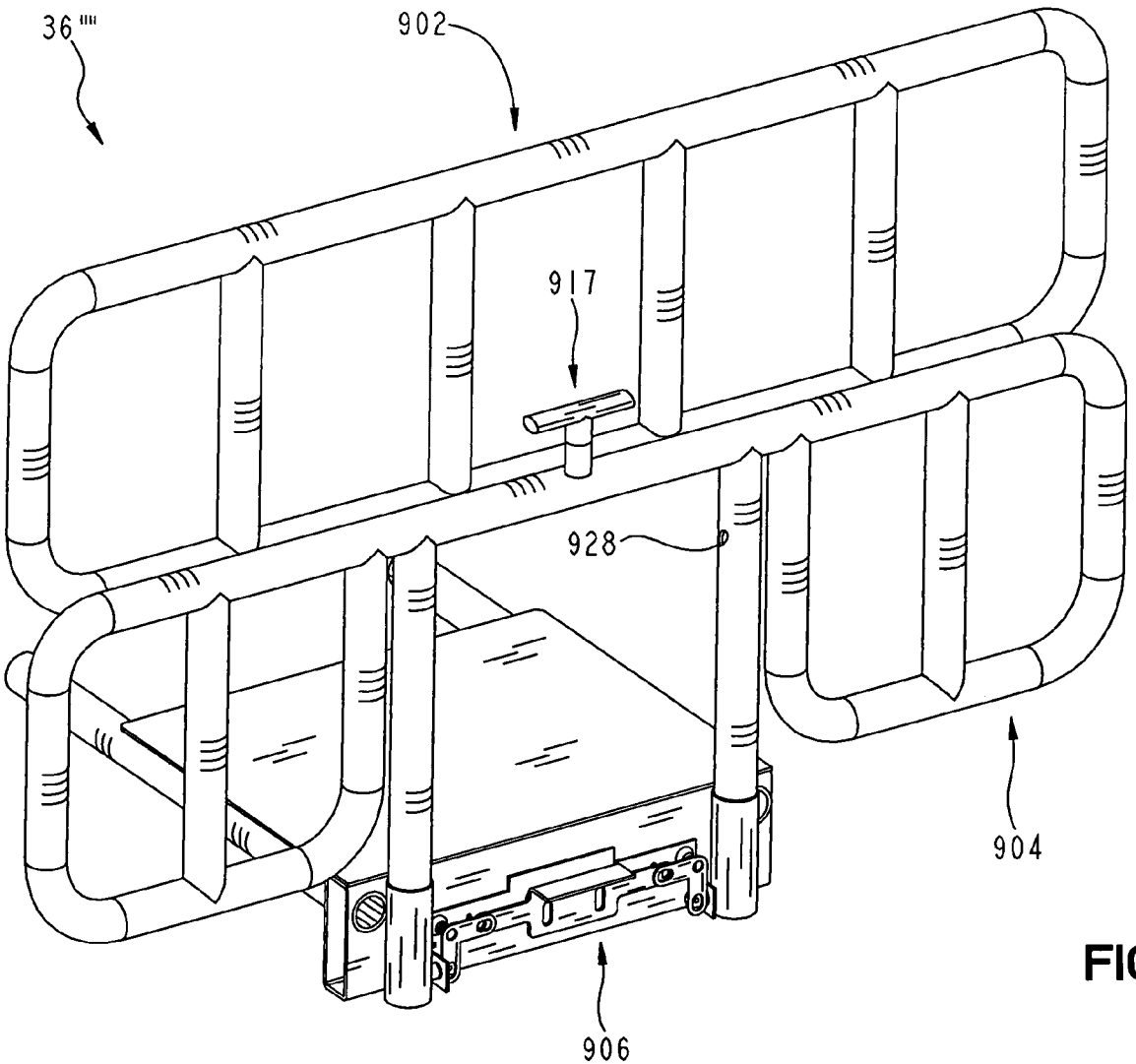
FIG. 21 is a perspective view of the siderail assembly of FIG. 19 in a lowered position.

Yet another illustrative embodiment siderail assembly 36"" is shown in FIGS. 19-21. Siderail assembly 36"" includes an upper siderail assembly 902 and lower siderail assembly 904. Upper siderail assembly 902 cooperates with lower siderail assembly 904 to permit upper siderail assembly 902 to move between the blocking position (FIG. 21), the intermediate position (FIG. 19), and rotate to the egress position (FIG. 20). In the egress position siderail assembly 36"" is below deck 18 of patient support 10.

Upper siderail assembly 902 includes, lower assembly receiving members 916*a*, 916*b*, upper blocker 911, lower blocker 913, and an upper release assembly 917. Lower blocker includes a first blocker member 918, and a second blocker member 920. Lower assembly 904 includes a height adjustment assembly 906 lower assembly interactive members 922*a*, 922*b* configured to be received by respective receiving members 916*a*, 916*b*. To rotate upper blocker 911 pull up on upper release assembly 917. A tube (not shown) is welded to upper blocker 911. second blocker member 920 runs through the tube and has a hole (not shown) to engage with 917.

Height adjustment assembly 906 includes a handle 908, bracket 909, a pair of release links 910, and a pair of release members (not shown) configured to cooperate with a pair of openings 928 in lower siderail assembly 904. Receiving member 916*a* includes an opening (not shown). This allows release members to interact with one of openings 928 and the opening in receiving member 916*a*. Release links 910 are coupled to handle 908 by a pair of link couplers 930 and release links 910 pivot about pivot pins 932. Release assembly 906 is biased in the rest position with release members locked in one of openings 928 in lower siderail assembly 904.

In operation, to move between the intermediate position (FIG. 19) and the egress position (FIG. 20), the caregiver uses height adjustment assembly 906. The caregiver lifts handle 908 upwards. Lifting handle 908 rotates release links 910 about pivot pins 932. The movement of release links 910 moves release members out of contact the opening in receiving member 916*a* and opening 928. This allows height adjustment of siderail assembly 36"". After movement begins, the caregiver releases handle 908 and handle 908 is biased towards its original position. In an alternative embodiment, siderail assembly 36"" is not locked in the egress position and movement upwards of siderail assembly 36"" is enabled without additional movement of handle 908. As siderail assembly 36"" returns to the intermediate position, release members lock into opening 928 in lower siderail assembly 904.

Although the invention has been described in detail with reference to certain preferred embodiments, variations and modifications exist within the scope and spirit of the present invention.

What is claimed is:

1. A patient support comprising: a frame; a deck including a sliding panel which slides to expand and retract the width of the deck, coupled to the frame, to support a mattress; and a siderail coupled to the sliding panel of the deck, the siderail including an upper assembly and a lower assembly, the upper assembly being configured to move with respect to the lower assembly between a blocking position and an egress position, the upper assembly configured to be securable in an intermediate position between the blocking and egress positions.

2. The patient support of claim 1, wherein the upper assembly includes a grip member, at least two lower assembly receiving members, and an upper release assembly.

3. The patient support of claim 2, wherein the lower assembly includes at least two interactive members configured to be received by the at least two lower assembly receiving members, an egress position assembly, and at least one latch opening.

4. The patient support of claim 3, wherein the at least two lower assembly receiving members are configured to slidably receive the at least two interactive members to allow movement between the intermediate position and the blocking position.

5. The patient support of claim 3, wherein the at least one latch opening is configured to receive a portion upper release assembly to lock the upper assembly in at least one of the blocking position, the intermediate position, and the egress position.

6. The patient support of claim 5, wherein the upper release assembly includes a handle, a shaft, a pair of holding members coupling the handle to shaft, and a pair of release members coupled to the holding members, the pair of release members configured to move from contact with the at least one latch opening to no contact with the at least one latch opening when the handle is lifted.

7. The patient support of claim 5, wherein the upper release assembly includes a handle, a pair of links operably coupled to the handle, and a pair of release members operably coupled to the pair of links, the pair of release members configured to move from contact with the at least one latch opening to no contact with the at least one latch opening when the handle is lifted.

8. The patient support of claim 1, wherein the lower assembly includes a rotation assembly configured to move the siderail from the intermediate position to the egress position.

9. The patient support of claim 8, wherein the rotation assembly includes a knob, a shaft operably coupled to the knob, and a shaft opening configured to receive the shaft.

10. The patient support of claim 9, wherein movement of the knob enables movement of the siderail from the intermediate position to the egress position.

11. The patient support of claim 1, wherein the siderail is configured to provide support to a patient.

12. The patient support of claim 11, wherein the siderail is configured to provide support to a patient weighing more than 400 pounds.

13. The patient support of claim 1, further including a width adjustment assembly, coupled to the deck, configured to expand the width of the deck from a first width to a second width.

14. The patient support of claim 13, wherein the width adjustment assembly cooperates with a width adjustment member to adjust the width of the deck.

15. The patient support of claim 14, wherein the width adjustment member includes a first width receiver and a second width receiver, at least one of the first width receiver and second width receivers being operable to hold the width adjustment assembly in one of the first width and the second width.

16. A patient support comprising: a frame; a deck coupled to the frame and configured to move between a first width and a second width; a mattress supported by the deck, the mattress including an upper surface and a lower surface; a width adjustment assembly operably coupled to the frame, the width adjustment assembly configured to move the deck between the first width and the second width; and a siderail coupled to the deck, the siderail configured to move with the deck between the first width position and the second width position; wherein the width adjustment assembly includes a locking member configured to be moved in a direction toward the frame from a locked position to an unlocked position to allow the deck to move from the first width to the second width; and wherein the width adjustment assembly is configured to move with the deck between the first width and the second width.

17. The patient support of claim 16, wherein the width adjustment assembly cooperates with at least one width adjustment member to adjust the width of the deck.

18. The patient support of claim 17, wherein the width adjustment member includes a first width receiver and a second width receiver, at least one of the first width receiver and second width receiver being operable to retain the width adjustment assembly in one of the first width and the second width.

19. The patient support of claim 16, wherein the siderail includes an upper assembly, a lower assembly, at least one of the upper assembly and the lower assembly being configured to move between a blocking position, an intermediate position, and an egress position.

20. The patient support of claim 19, wherein the upper assembly includes at least two lower assembly receiving members configured to receive the lower assembly and an upper release assembly configured to lock the upper assembly in at least one of the blocking position, the intermediate position, and the egress position.

* * * * *